United States Patent [19]

Kuroda et al.

[11] Patent Number: 4,958,500

[45] Date of Patent: Sep. 25, 1990

[54] AIR CONDITIONER AND AIR CONDITIONING METHOD

[75] Inventors: Shigeaki Kuroda; Kensaku Oguni, both of Shimizu; Takao Senshu, Shizuoka; Hirokiyo Terada, Shizuoka; Makoto Nagai, Yaizu; Masamichi Hanada, Shimizu, all of Japan

[73] Assignee: Hitachi, Ltd., Tokyo, Japan

[21] Appl. No.: 340,684

[22] Filed: Apr. 20, 1989

[51] Int. Cl.[5] ..... F25D 17/06

[52] U.S. Cl. ..... 62/89; 62/263; 62/412

[58] Field of Search ..... 62/41 L, 41 LA, 414, 62/259.1, 263, 262, 89

[56] References Cited

U.S. PATENT DOCUMENTS

| | | | |
|---|---|---|---|
| 2,644,321 | 7/1953 | Borgerd | 62/263 |
| 2,702,994 | 3/1955 | Borgerd | 62/263 |
| 2,729,072 | 1/1956 | Dybvig | 62/262 X |
| 2,743,908 | 5/1956 | Tanner | 62/263 X |
| 3,308,634 | 3/1967 | Smith | 62/263 |
| 4,505,328 | 3/1985 | Schmitt | 62/263 X |

FOREIGN PATENT DOCUMENTS

| | | |
|---|---|---|
| 63654 | 5/1976 | Japan . |
| 121342 | 9/1980 | Japan . |
| 152225 | 11/1981 | Japan . |
| 196734 | 12/1983 | Japan . |
| 178742 | 11/1985 | Japan . |
| 17289 | 5/1986 | Japan . |
| 40274 | 10/1987 | Japan . |
| 57900 | 12/1987 | Japan . |

*Primary Examiner*—Lloyd L. King

*Attorney, Agent, or Firm*—Antonelli, Terry, Stout & Kraus

[57] ABSTRACT

An air conditioner mounted on a vertical wall and an method, with the air conditioner including air intake ports and air exhaust ports provided on each side of and air conditioner body which contains heat exchangers, fans and motors. The air is drawn in from the sides of the air conditioner where it is heat-exchanged and then discharged from sides thereof.

10 Claims, 12 Drawing Sheets

FIG. 8
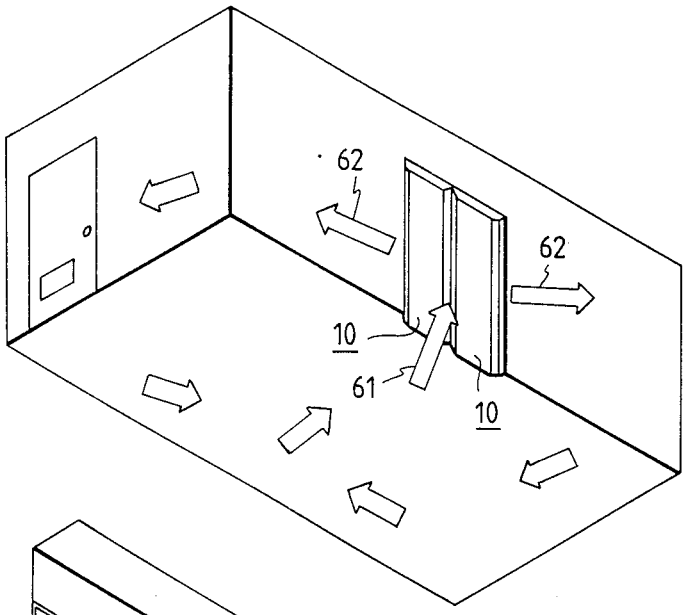
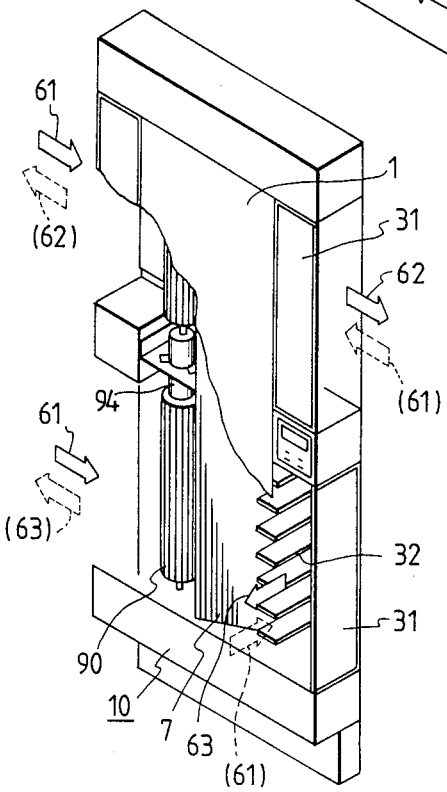
FIG. 9

AIR CONDITIONER AND AIR CONDITIONING METHOD

BACKGROUND OF THE INVENTION

This invention relates to an air conditioner method of an air conditioning method and, more particularly, to the construction of an indoor unit of an air conditioner which can suitably be used as an interior furniture and provide high level of comfortableness in the room.

Indoor units of conventional air conditioners, as described in, for example Japanese Utility Model Unexamined Publication No. 152225/1981, draws air is drawn in from the front of the unit and discharge the same from the top. In other constructions currently available, the air is drawn in from the front of the unit and discharged from the top and bottom of the unit, as disclosed in for example Japanese Patent Examined Publication No. 57900/1987. Japanese Utility Model Examined Publication No. 40274/1987, proposes an arrangement wherein the air is drawn in from the front of the unit and the air is discharged out from the top of the unit during the cooling operation and from the bottom of the unit during the heating operation. Further, as described in Japanese Utility Model Examined Publication No. 17289/1986, the air is taken in from the rear corners of the unit and discharged from the lower front part of the unit; or the air is taken from the upper part of the unit and discharged from the bottom of the unit.

For those constructions with the air intake ports arranged at the front of the unit, the unit image is determined by the grille at the intake ports and it is often difficult to match the design of the front of the unit with the interior of the room. This is especially true for the floor stand type air conditioners because the area on the wall occupied by the unit is large and the unit's depth is also large (200 mm or more). In other constructions in which the air intake ports are provided at the rear corners or at the top of the unit and the air exhaust ports at the bottom of the unit to make the unit more easily compatible with the interior of the room, there is a drawback that the blowing air directly strikes people in the room (especially during the heating operation), thus making them uncomfortable.

An object of this invention is to provide an air conditioner which can easily be decorated to match the interior of the room.

Another object of the invention is to provide an air conditioner and an air conditioning method which can improve the level of comfortableness in the room.

A further object of the invention is to provide an air conditioner unit in which arrangement of the air intake and air exhaust ports can be changed in accordance with the configuration of the room space and the interior layout to improve the comfortableness; which consumes less energy than do the conventional units; and which can easily be reconciled with the interior of the room.

A further object of the invention is to provide a panel whose dimensions projecting from the wall surface or from the ceiling is small thus minimizing the obstructiveness of the unit.

Still another object of the invention is to provide an air conditioner in which the mounting and decorating the decorative boards can be done at the same time that the air conditioner is installed.

To achieve the above objectives, the air conditioner of this invention comprises a heat exchanger, fans, motors to drive the fans, and air inlet ports and air outlet ports at the sides of the front panel of the unit.

Another feature of the invention is an air conditioner which comprises an indoor air conditioner unit installed along a vertical wall of the room and air intake ports and air exhaust ports provided at the lateral sides of the unit.

A further feature of the invention is an air conditioner which comprises: a vertically elongate cabinet; reversible cross-flow fans provided in the sides of the cabinet; a heat exchanger installed in the cabinet; a plurality of air intake and air exhaust ports provided at each side of the cabinet through which air is drawn in or blown out; and an air passage so arranged that the air drawn in from at least one of the ports is made to pass through the heat exchanger and blow out of the cabinet from at least one of the ports by the action of the fans.

In accordance with the method of the invention: an air conditioner is provided which has air intake and exhaust ports at the sides of the upper and lower part thereof, wherein during a cooling operation, air is drawn in from the lower ports, cooled, and discharged air from the upper ports; whereas during a heating operation, air is drawn in from the upper ports, heated, and delivered as warm air from the lower ports.

In accordance with further features of the method of the invention during the cooling operation, air is drawn into the air conditioner from the sides at the lower part, cooled, and delivered as cool air forwardly slantwise from the sides at the upper part; whereas during the heating operation, air is drawn into the air conditioner from the sides at the upper part, heated, and delivered as warm air forwardly slantwise from the sides at the lower part.

A still further feature of the invention is an air conditioner resides in the fact that an air conditioner body is embedded in a wall of the room , with frames for mounting the air conditioner on the wall, and a designer panel mounted on the front of the air conditioner body, wall decorative boards are mounted on each side of the air conditioner body in front of the frames, and air intake and air exhaust ports are formed between the wall decorative boards and the designed panel.

Other features, objects and advantages of this invention will become apparent from the following description in connection with the attached drawings.

BRIEF DESCRIPTION OF THE DRAWINGS

FIG. 8 is an example of combined of the air conditioner units of FIG. 6;

FIG. 9 is a perspective view of another example of the indoor unit of the air conditioner with a part of the front cover cut away;

DESCRIPTION OF PREFERRED EMBODIMENTS

To reconcile the air conditioner unit with the interior of the room to be air-conditioned can be achieved by making the unit thin (in depth) and the unit's front panel large, and providing the air inlet and outlet ports along the periphery of the front panel. For improved comfortableness, multiple air blowing ports are provided for occupants in the room to choose a desired air blowing direction and also the air blowing ports are vertically elongated. This reduces the chance of the air stream blown out from the air conditioner directly flowing against the occupants in the room.

Forming the air conditioner unit thin (say, less than 200 mm in depth) makes the person in the air-conditioned room less conscious of the presence of the indoor unit or makes the outdoor unit less conspicuous. With the thin unit, it is possible to increase the front panel area of the air conditioner unit nearly to the entire front area of the unit and give the panel some designs coordinated with the interior setting of the room (such as by pasting it with the same wallpaper as that used in the room or painting it in the same color as the room or the wall). In this air conditioner unit, the only portions that remain distinctively showing are the air inlet and outlet. They are then formed as slits at the lateral corner or at the top and bottom of the unit to make the unit less conspicuous.

In such air conditioner unit constructions, the comfortableness can be improved by providing plural air blowing ports to control the air stream. For example, a total of four air blowing ports may be formed, two ports on each lateral side. During the cooling operation the air is blown from the upper lateral ports out into the upper part of the room to spread the cool air over the entire area in the room. This prevents the cool air from directly blowing against the people in the room and making them feel uncomfortable. Further, the inlet ports are provided at the lateral sides, so that if a person stands immediately in front of the unit, he or she is not exposed to the air stream entering the unit and thus will not feel uncomfortable.

During the heating cycle, the warm air is supplied from the lower slit outlets on each side of the unit. The warm air flows along the wall, warming the entire space of the room until it reaches the upper part of the room. In this case, providing guide plates to the unit blowing section so that the blowing air will not directly strike the occupants will produce more desirable effects. Moreover, the comfortableness can also be improved further by automatically swinging the guide plates to change or swing the blowing air stream and thereby make the temperature distribution in the room uniform.

Figure 1:
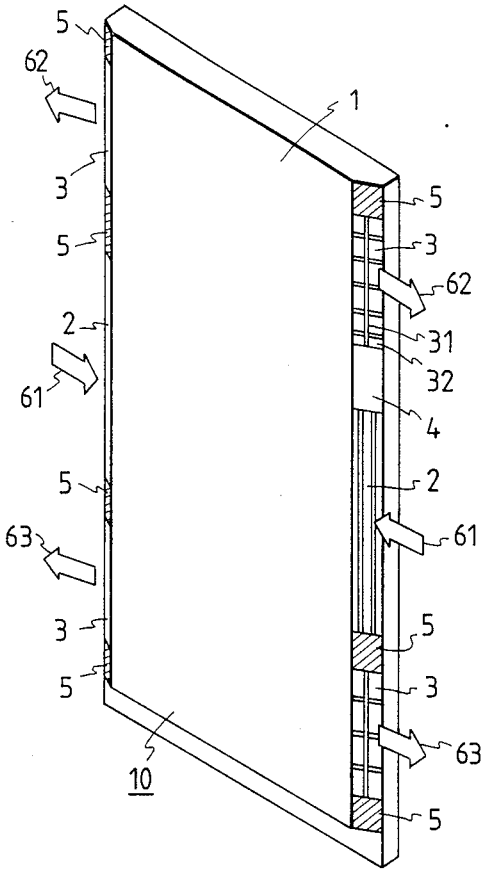
FIG. 1 is a perspective view of one embodiment of an air conditioner of this invention.
Figure 3:
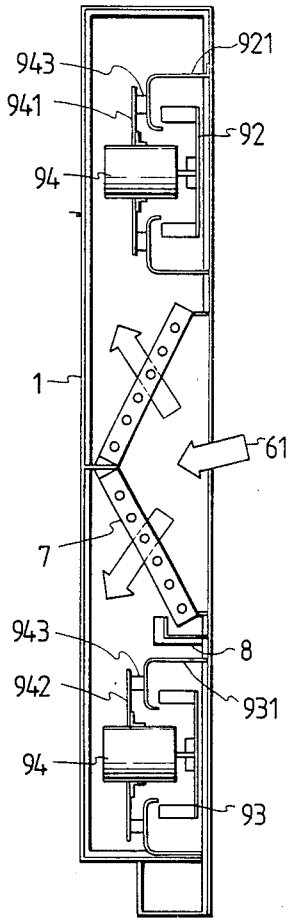
FIG. 3 is a lateral cross-sectional view of the air conditioner of FIG. 1.
Figure 4:
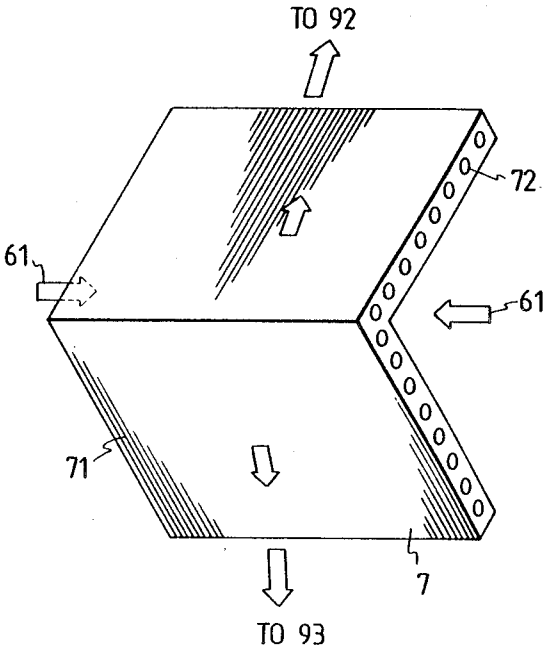
FIG. 4 is a perspective view of a heat exchanger as shown in FIGS. 2 and 3.

Referring not to the drawings wherein like reference numerals are used throughout the various views to designate like parts and, more particularly, to FIGS. 3 and 4, according to these figures, a V-shaped heat exchanger 7 is provided with a drain pan 8 being disposed immediately below the heat exchanger 7 to receive dripping water produced as a result a dehumidifying process, with fans 92, 93 installed above and below the heat exchanger 7. Casings 921, 931 of the fans 92, 93 each draw air from the lateral sides of the front cover 1 at its vertically central portions and discharges air out from the upper and lower portions in two lateral directions. Below the upper air outlet port 3 of the unit is mounted an operation panel 4 that controls the fans 92, 93 and the unit as a whole. Barrier plates 5 are arranged between the top portion and the bottom portion of the unit and between the air intake portion and the air exhaust portion to prevent the discharged air from being directly drawn into the intake portion, thus preventing reduction in efficiency of the air conditioner.

Figure 5:
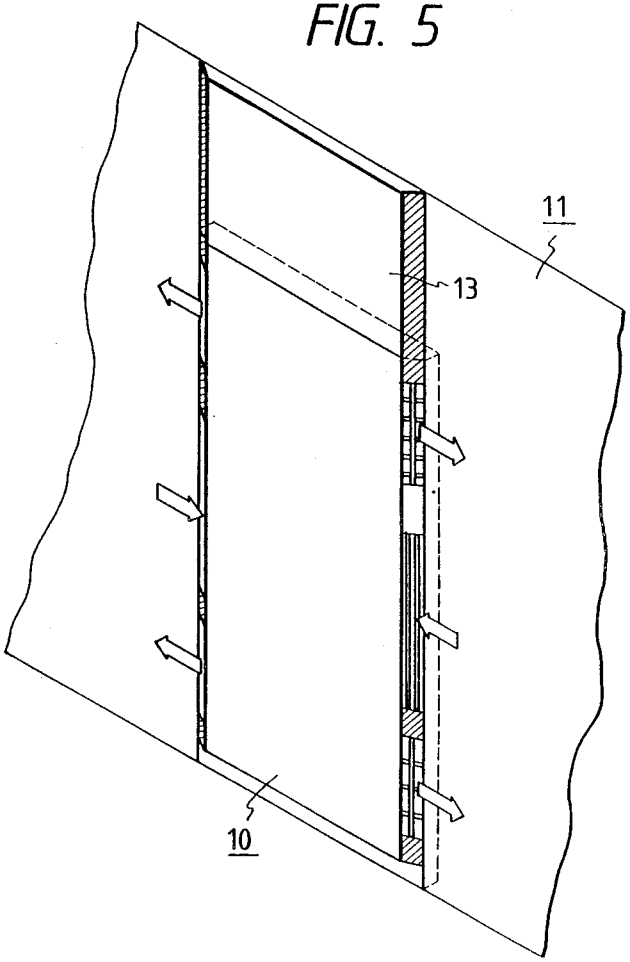
FIG. 5 is a perspective view showing the air conditioner of this invention mounted on a wall.

In the above construction, the air conditioner unit has no air inlet or outlet port at the front part, so that the front panel can be decorated in coordination with the interior setting of the room including color of the wall or design on the wallpaper. This reconciles the air conditioner of this embodiment with any kind of room. As shown in FIG. 5, the air conditioner can also be embedded in the wall for better coordination with the room, with an exposed part of the unit projecting forwardly from the wall preferably set to 0 to 50 mm to further enhance the roomy atmosphere. The provision of a separate-piece 13 also reduces the degree of obstructiveness of the unit.

The air in the room is introduced by the fans 92, 93 into the unit through the intake ports 2 on each side. Then, the air enters the heat exchanger 7 where it is cooled by the coolant (during the cooling operation) and drawn into the fans to be blown out from the outlet or exhaust ports 3 on each side into the room. The amount of air delivered from the fans 92, 93 can be changed by controlling the revolution speeds of the fans. One example setting of the air flow being shown in Table 1.

TABLE 1

| Air flow setting | Cooling | | Heating | |
|---|---|---|---|---|
| | Fan | | | |
| | 62 | 63 | 62 | 63 |
| Strong | 130% | 70% | 70% | 130% |
| Medium | 100 | 50 | 50 | 100 |
| Weak | 80 | 40 | 40 | 80 |

As shown in Table 1, during the cooling operation the upper fan 92 supplies a larger amount of air while reducing the air flow from the lower fan 93. Conversely, during the heating operation, a greater flow of air is supplied from the lower fan 93 with a smaller amount of air blown from the upper fan 92. The outgoing air flow is regulated by vertical louvers 31 and horizontal louvers 32 so that the cool or warm discharged air does not directly strike a person and make the person uncomfortable. By automatically swinging the vertical louvers 31, the blowing air is spread in the entire room improving the comfortableness in the room. When the heat loads on each side of the air conditioner unit differ from each other, it is possible to regulate the amount of air blown from the left and right side by controlling reflectors 922, 932 in the fan cases. That is, if the reflector 92 on the right side is set as shown in the dotted line in FIG. 2 the air flow resistance of the reflector increases to reduce the air flow toward the right.

With the above construction of this indoor air conditioner unit, it is possible to freely change the ratio of air flows discharged in four directions, up, down, right and left. At the same time, it is also possible to freely change the air flow direction. This in turn makes it possible to provide the desirable air conditioning in accordance with the conditions inside the room.

As described above, this invention permits the indoor air conditioner unit to be decorated to match the room interior. Furthermore, since the air intake and outlet ports are provided at the sides of the air conditioner unit and in the form of slits, the unit itself becomes thin, and snugly fits into the room interior setting.

Since a plurality of intake and outlet ports are provided, it is possible to produce air streams that will best suit the requirements of the occupants in the room. Another feature of this invention is that the air is made to flow out forwardly from the sides of the air conditioner unit, so that the heat-exchanged air does not directly strike people in the room but flows along the walls enclosing the central part of the room to substantially improve the comfortableness in the room.

The heat exchanger 7 in the indoor air conditioner unit may not necessarily be V-shaped V lying on its side but may be formed as an V or may be I-shaped I.

Figure 6:
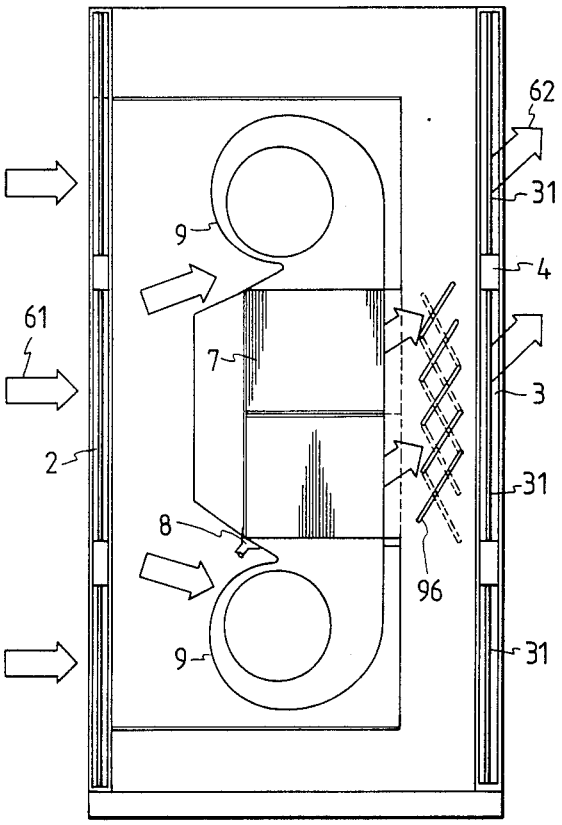
FIG. 6 is a schematic view of the internal structure of the air conditioner unit when the front cover of the unit is removed.
Figure 7:
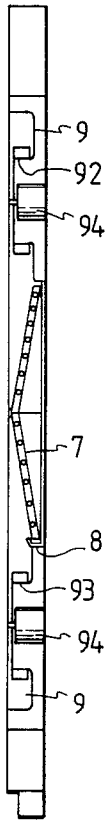
FIG. 7 is a lateral cross-sectional view of FIG. 6.

FIGS. 6 and 7 show the indoor air conditioner unit of FIGS. 1 through 4 with a portion of the inner structure changed. As shown in FIGS. 6 and 7, the heat exchanger 7 is provided at the center of the unit and one-way flow fans are installed above and below the heat exchanger 7. The air in the room is drawn into the unit from one side as indicated by the arrow 61 and into the upper and lower fans in the unit, from which it is delivered to and passed through the heat exchanger 7 to be cooled or heated. The heat-exchanged air is then discharged into the room from the other side, opposite to the intake side. Guide vanes 96 are inclined upwardly as shown by the solid line during the cooling operation to direct the cool air upward as indicated by the arrow 62. Conversely, during the heating operation, the guide vanes 96 are inclined downwardly as shown by the broken line to direct the warm air downward. The vertical louver 31 adjusts the direction of the outgoing air flow forwardly or rearwardly.

In the example of FIG. 6, it is possible to change the direction of the discharge air to the opposite direction (to the left) by changing the mounting directions and positions of the fans 9 and the heat exchanger 7. Two units, which are laterally symmetrical with each other, may be combined as shown in FIG. 8, with their air intake sides put close together. This arrangement allows the air to be blown out from both sides to improve the capacity of the air conditioner as well as the coziness in the room.

FIG. 9 shows a still another example of the indoor air conditioner unit 10, in which reversible cross-flow fans are provided in the upper and lower part of the unit with the heat exchanger 7 placed by the side of the reversible cross-flow fans, with the construction of other components being similar to the proceding ones.

Figure 2:
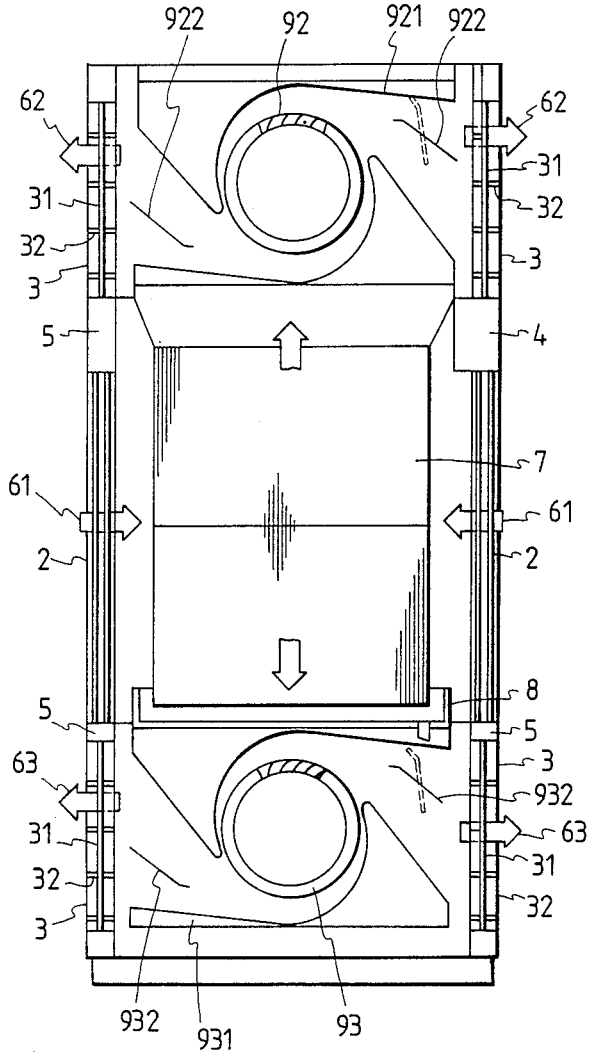
FIG. 2 is a front view of the air conditioner of FIG. 1 with a front panel removed.
Figure 11:
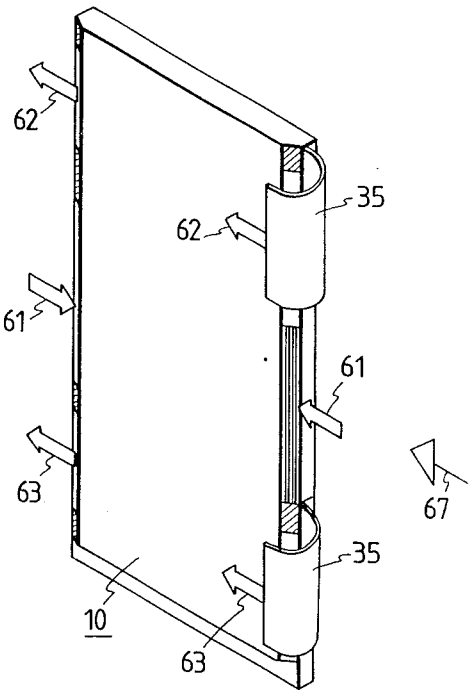
FIG. 11 is a perspective view showing the outdoor unit of FIG. 10 mounted with a guide plate.
Figure 10:
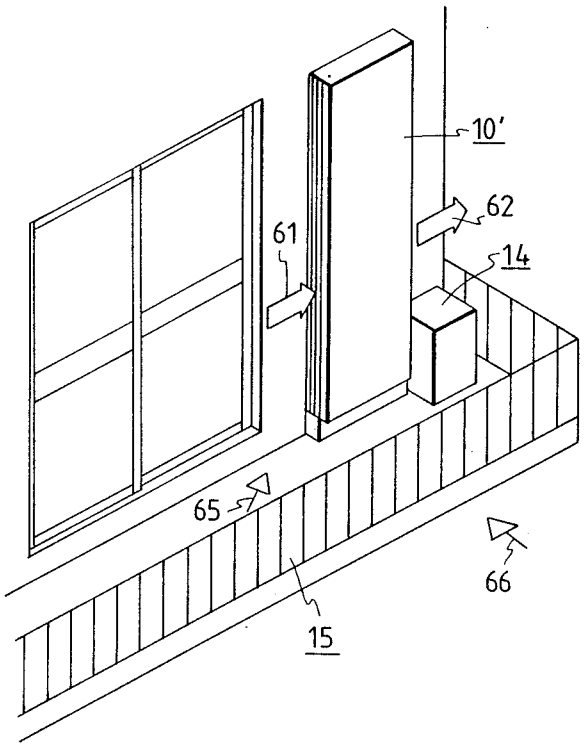
FIG. 10 is a perspective view showing the air conditioner indoor unit of in FIG. 6 or 9 used as an outdoor unit.

FIG. 10 shows an example in which the indoor air conditioner unit 10 shown in FIG. 6 or 9 is used as an outdoor unit 10'. The outdoor unit 10' is mounted to the structural outer wall on a balcony 15 with a compressor unit 14 installed by the side. Because the air conditioner of this invention can be formed in a thin structure, it does not take a large installation space on the veranda. Also, since the front of the indoor unit is formed as a panel, it is possible to decorate it so that it matches the color or design of the surrrounding wall, thus eliminating the obstrusiveness of the unit 10. As to the outdoor unit, when strong winds blow against the outlet ports of the unit, the outgoing air flow is reduced and the vanes of the fan may be damaged. With this invention, however, there is no danger of the vanes being damaged or the air flow being reduced by the wind 66 striking it from the front or by the wind 65 in the direction of the air intake. The wind blowing against the unit from the air outlet side may reduce the amount of air exhausted from the unit. However, once the installation position is determined, the direction of the outgoing air is also determined. Thus, the optimum direction of the outlet port can be chosen considerating the direction of wind. In the unit of FIG. 2 equipped with the reflectors 922, 932, the effect of wind can be minimized by closing the reflectors 922, 923 against the wind. As shown in FIG. 11, the provision of guide plates 35 at the air outlet ports of the unit on the side against which the wind is blowing can completely nullify the adverse effects of the wind. In the unit shown in FIG. 9, since the direction of the outgoing air can be changed freely, it can be set so that the outlet port is not directed against the wind. Furthermore, when there are obstructive objects such as a house, tree, or potted plant nearby, they can be protected from the heat of the air blown out of the outdoor unit by deflecting the outgoing air stream.

Figure 12:
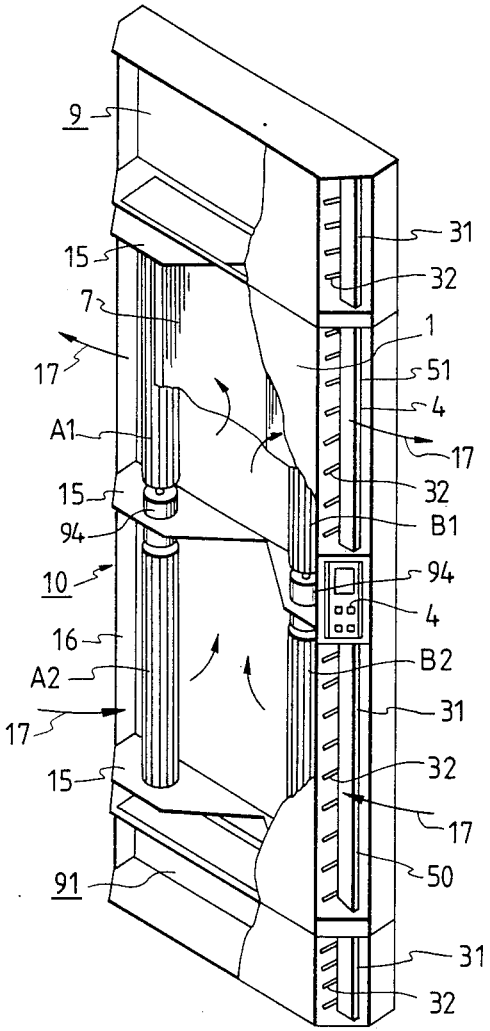
FIG. 12 is a partial cut-away perspective view.

FIGS. 12 through 15 show other examples of the indoor air conditioner unit 10 with the inner construction changed. In these examples, the air conditioner unit 10 consists of four reversible cross-flow fans A1, A2, B1, B2 on each side of the vertically elongated cabinet 16, and two fan drive motors 94 installed between the fans A1, A, and between the fans B1, B2. The V-shaped heat exchanger 7 is arranged vertically along the length of the fans. On the outer side of each fan opposite to the heat exchanger 7, there are air intake and outlet ports 50, 51. In the air intake and outlet ports, guides vanes 31, 32 are installed to control the direction of air stream. An operation panel 4 to control the air conditioner unit is mounted between the air intake and outlet ports 50, 51. A partition plate 15 that divides the air stream is provided at the top of the upper fans and bottom of the lower fans and at a position between the upper and lower fans, extending from the heat exchanger 7 to the fan inlet and outlet ports. On the front of the air conditioner unit is mounted a front cover 1 which has no air intake or outlet ports. In FIG. 12, separate-piece ducts 9, 91 are mounted at the top and bottom of the body of the unit 10. In the air conditioner construction of this invention, the front panel can be decorated so that it matches the interior of the room to minimize the obstrusiveness of the air conditioner unit. In this example, each fan motor 94 drives two reversible cross-flow fans A1, A2 or B1, B2. It is also possible to provide a motor for each fan, for more freedom of selection in the directions of air inflow and outflow.

Next, the operation of the components making up the air conditioner unit and the air flow will be explained. First, turning to FIG. 13, in which the process of switching the air flow direction by the reversible cross-flow fan is illustrated. As show in FIG. 13, the reversible cross-flow fan 12 (A1, A2, B1, B2) is rotating in the direction indicated by the arrow 161. A rotating case 173 is mounted on a rotating ring 172 and when the rotating case 173 is at rest, as shown in shade in FIG. 13, a vortex 180 is produced in the fan, causing the air to flow in the direction indicated by the solid arrow 17. When the rotating case 173 is turned 180° by the rotating ring 172, the rotating case 173 moves to the position indicated by the broken line. As a result, the vortex in the fan forms at the position indicated by the broken line 181, causing the air steam to flow in the direction of the broken arrow 17. In this manner, the direction of air flow can be changed by changing the position of the rotating ring 172, thus making it possible to use the port 50 either as an air intake or exhaust port.

Figure 13:
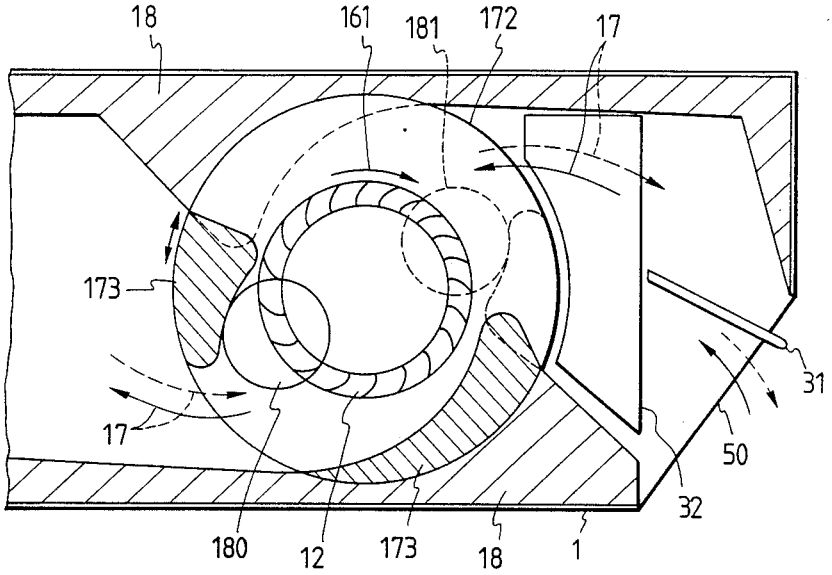
FIG. 13 is a horizontal cross-sectional view of a reversible cross-flow fan section.

The rotating ring 172 shown in FIG. 13 is determined so that the air flow produced by the lower fans A2, B2 will enter the unit and that the air flows by the upper fans A1, B1 will go out (into the room). In this condition, when the air conditioner unit is operated, the air in the room is drawn into the unit from both sides as indicated by the arrows 17 by the two lower reversible cross-flow fans A2, B2.

The air that has entered from the intake port 50 on each side now passes through the heat exchanger 7 in which it imparts heat to the coolant, i.e., it is cooled by the coolant. The cooled air streams from both sides merge together before passing through the partition plate 15 at the center and reaching the top of the unit. Then the air stream branches into the right and left streams, which pass through the upper part of the heat exchanger 7 before being discharged into the room from the outlet ports 51 by the upper reversible cross-flow fans A1, B1, as shown by the arrow 17. The basic air flow during the heating operation is the reverse to the cooling operation. The position of the rotating ring 172 is adjusted so that the upper reversible cross-flow fans A1, B1 send air into the unit and that the lower reversible cross-flow fans A2, B2 send air out into the room. The air in the room is then drawn into the unit from both sides of the upper part of the air conditioner unit and the warmed air is blown from both sides of the lower part of the unit. In this manner, during the cooling operation the air in the room is taken in from both sides of the lower part of the unit and the cool air is blown out from the upper part of the unit, while during the heating operation the air is taken in from the upper part of the unit and the warm air is blown out from the lower part. Since the air outlet ports are vertically elongated on each side of the unit, the cool or warm air envelops the room space from both sides.

Figure 15:
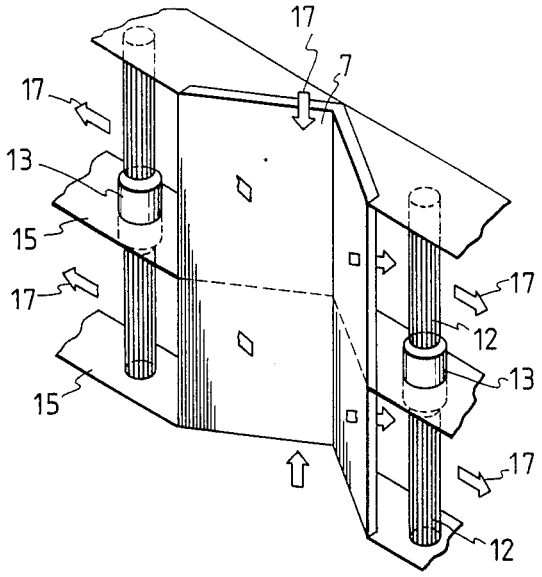
FIG. 15 is a perspective view of a portion of the internal structure of the air conditioner unit of the present invention illustrating the air flow.

The above air flows are basic patterns during the cooling and heating operations and there are basically eight different combinations of air intake and exhaust patterns to choose from, according to the locations of furniture, equipment or people in the room, as shown in Table 2 with pattern of a being V an example B and explained by referring to FIGS. 12 and 15.

TABLE 2

| | Fan | | | | | | | | |
|---|---|---|---|---|---|---|---|---|---|
| | Fan A1 | | Fan A2 | | Fan B1 | | Fan B2 | | |
| | Direction of flow | | | | | | | | Direction of flow |
| Pattern | In | Out | In | Out | In | Out | In | Out | |
| I | o | | o | | | o | | o | → → |
| II | | o | | o | o | | o | | ← ← |
| III | | o | o | | | o | o | | ↺ ↻ |
| IV | o | | | o | o | | | o | ↺ ↻ → |
| V | | o | | o | | o | | o | ↺ ↻ → |
| VI | o | | o | | o | | o | | ⇄ ⇄ |
| VII | o | | | o | | o | o | | → ← |
| VIII | | o | o | | o | | | o | ← → |

First, an air intake port is provided to each side of the separate-piece ducts 9, 91 of FIG. 12.

The rotating ring 172 is adjusted for all four reversible cross-flow fans 12 so that the air will discharged from the air conditioner unit into the room. Thus, the air in the upper part of the room is drawn in from the lateral sides of the upper separate-piece 91 and introduced into the air conditioner unit 1. The air then passes through the heat exchanger 7 before being delivered out from the sides of the unit by the reversible cross-flow fans A1, B1. The air drawn in by the lower reversible cross-flow fans A2, B2 is introduced through the lower separate-piece duct 91 into the unit and then blown out from the lower lateral sides of the unit. In this way, the provision of air paths to the heat exchanger 7 at the top and the bottom of the unit increases the number of possible combinations of the air intake and exhaust patterns.

Figure 14:
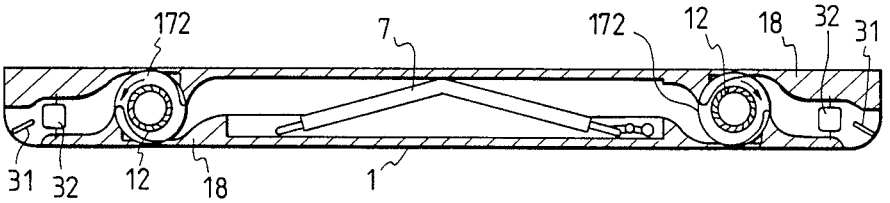
FIG. 14 is a horizontal cross-sectional view of the unit of FIG. 12.

Though not shown in FIG. 14, it is possible to make only one of the four fans draw the air into the unit and the remaining three blow the air out of the unit. Or conversely, one of the fans can be made to deliver cool or warm air out into the room.

Since in this example the air outlet port of the air conditioner unit is vertically elongated on each lateral side of the unit, the cool or warm air supplied from the unit flows along the wall enveloping the room space from both sides, cooling or warming the atmosphere therein. Also, since the optimum combination of air intake and exhaust patterns can be formed according to the locations of furniture, equipment or people in the room, it is possible to provide a cozy space. Moreover, the front cover 1 and the separate-piece ducts 9, 91 can be decorated to match the interior of the room, the air conditioner unit serves as an effective interior furniture.

With this invention, a high level of comfortableness can be provided because a desired combination of air intake and exhaust port patterns can be chosen during the cooling or heating operation according to the shape of the room to be air-conditioned or according to the locations of equipment or furniture or people occupying the room.

Figure 16:
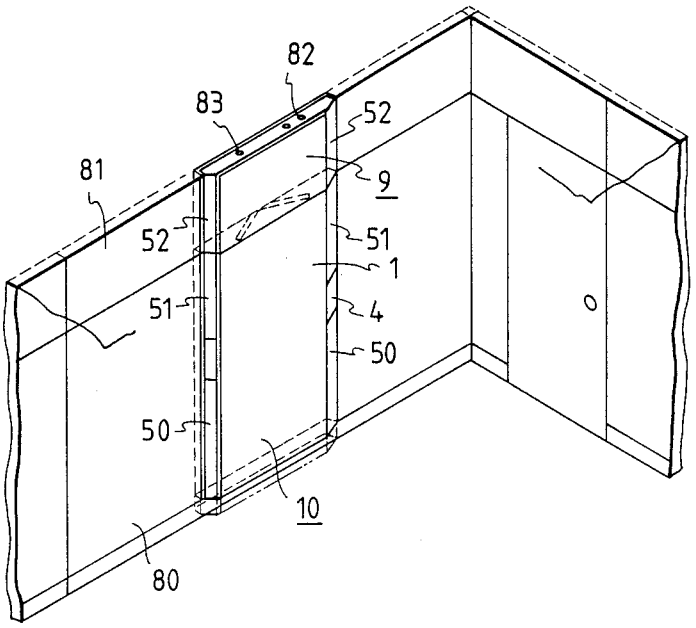
FIG. 16 is a perspective view showing the unit of FIG. 12 mounted on a room partition board.

FIG. 16 shows an example in which the air conditioner unit 10 of FIG. 12 is built into a partition wall 80. Between the top of the air conditioner unit 10 and the ceiling 81 is inserted the separate-piece 9 whose lateral sides are formed as air intake and exhaust ports 52. A coolant piping port 82 and a drain pipe 83 is also provided.

Still another example of the air conditioner unit will be described, for which the installation of the unit as well as the fitting and decorating of design panel or board can be done at one time. A design panel is divided into wall decorative boards located on each side of the panel and a panel section located at the center. The wall decorative boards are mounted on wall-mounted decorative boards and joined to the air conditioner unit body. The center design panel section is joined to the air conditioner unit body with the air intake and exhaust ports located between the wall decorative boards and the design panel section.

Figure 17:
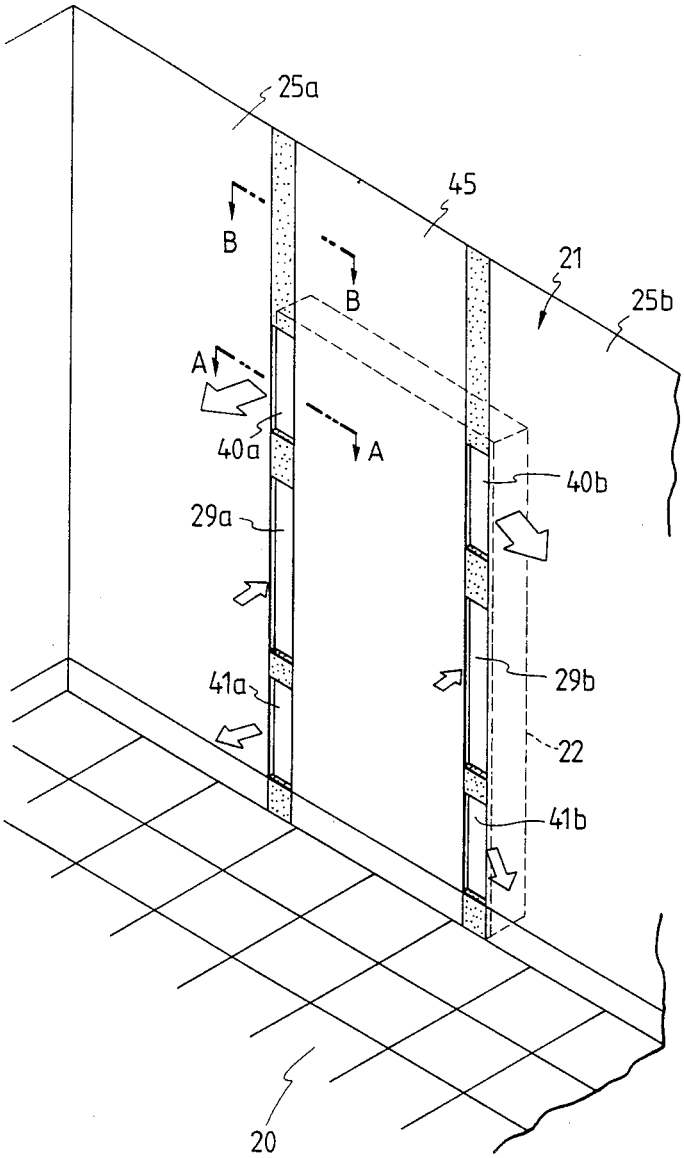
FIG. 17 is an overall perspective view of an embedded air conditioner unit in accordance with the present invention.
Figure 18:
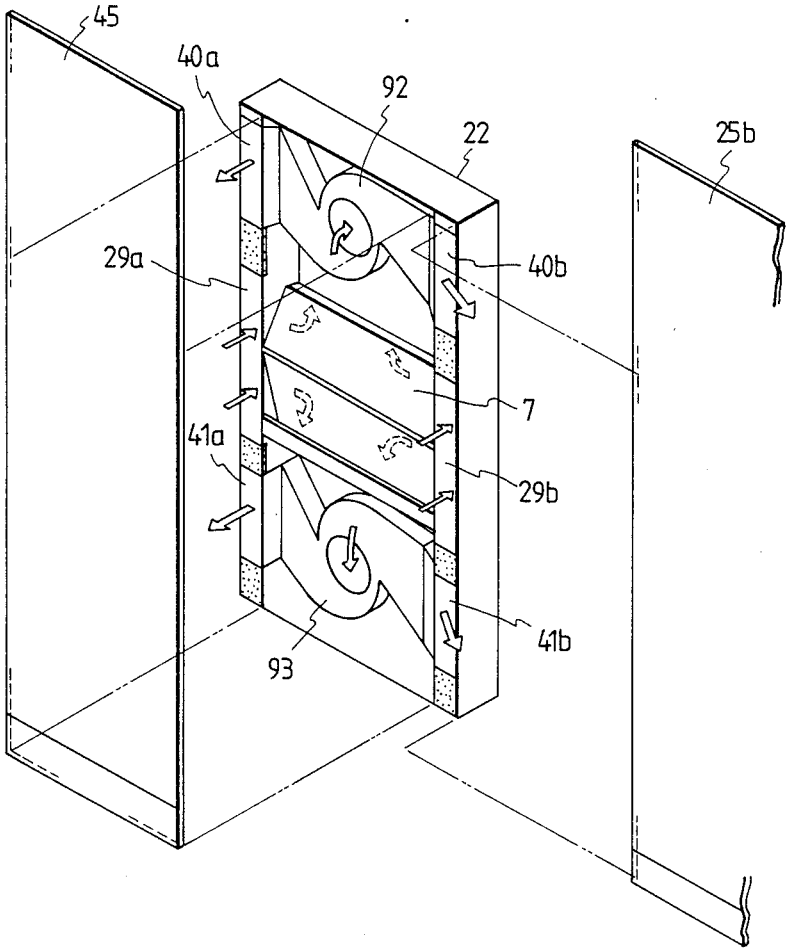
FIG. 18 is an explanatory view illustrating an assembly of a designer panel and wall decorative boards.
Figure 19:
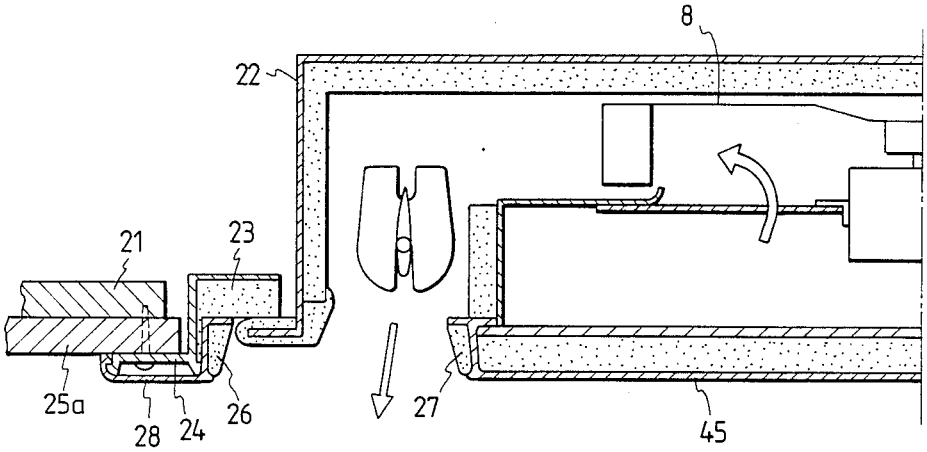
FIG. 19 is a cross-sectional view taken along the line A—A in FG. 17.
Figure 20:
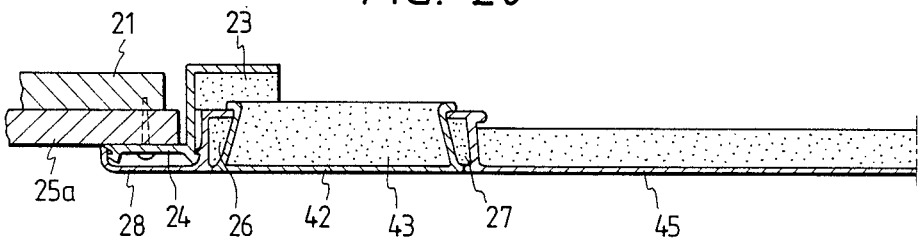
FIG. 20 is a cross-sectional view taken along the line B—B in FIG. 17.

FIG. 17 shows the floor type air conditioner with and interior job on the wall presumed to have been completed except for an area of the wall surface 21, from the floor 20 up to the ceiling, where the air conditioner body is to be installed. As shown in FIGS. 19 and 20, a frame 24 which has a resilient seal packing 23 for hermetically sealing the outer shell of the air conditioner unit body 22 from the back is secured to the wall decorative boards on each side of the unit as by staples. The frame conceals the unaligned end surface of the boards and is dimensioned to the installation size of the unit body 22. To absorb the lateral deviations between the unit body 22 and the frame 24, which occur at the upper and lower part of the unit 22 due to attitude difference between the unit body 22 and the wall 21, an overlapping part is provided to the frame 24 and the end surfaces of the unit body 22. The air conditioner unit body 22 is inserted into the opening in the wall from the front and fixedly installed there. The unit body 22 is so constructed that the power supply wiring connection, coolant piping connection and drain piping connection can be carried out from the front of the unit body 22. With the unit body 22 installed, a design panel 45 which has engagement claws on each side and also has noise-proof and heat insulating material attached thereto is installed on the unit covering the area from the ceiling down to the floor. Wall decorative boards 28, which are bonded with decorative heat insulating materials 26, 27 to prevent dew condensation at the air outlet ports are also installed on each side of the design panel 45, extending from the ceiling down to the floor. Recesses, gaps and bulges above or below the air intake ports **29*a*, 29*b* and the air outlet ports 40*a*, 40*b*, 41*a*, 41*b* are closed by spacers 42 to make the front of the unit a flat surface in which the wall decorative boards 28 and the design panel 45 are flush with each other. The spacers 42 are bonded at the back with heat insulating material 43 to prevent dew formation. The spacers 42 are dimensioned in such a manner that the width is smaller toward the back of the wall with engagement claws 44** provided at the rear ends.

With this embodiment, since the air conditioner unit can be installed after the wall surface has been prepared and since it is entirely built into the wall, the design on the wall surface is protected against damage. Another feature of this air conditioner is that the mounting screws are not exposed from the front side. Furthermore, since the design panel is attached to the unit using no fixing screws, it can easily be dismantled facilitating the maintenance service and simplifying the installation work. Also, since the panel projection from the wall can be limited to about 5 mm, it is possible to conceal the air conditioner unit by covering the entire surface of the unit except for the air intake and exhaust ports, thereby making the unit one of the interior items.

What is claimed is:

1. An air conditioner mounted on a vertical wall, the air conditioner comprising:

a heat exchanger means;

fan means for drawing and discharging air from the air conditioner;

motor means for respectively driving the fan means;

an air intake port means provided on each lateral side of a front panel of the air conditioner for drawing air into the air conditioner; and air exhaust port means provided on each lateral side of the front panel of the air conditioner unit for discharging the air from the air conditioner, whereby air is drawn into and discharged from each lateral side of the air conditioner.

2. An air conditioner as set forth in claim 1, wherein reversible cross-flow fan means are provided near the air intake port means and the air exhaust port means.

3. An air conditioner comprising:

an indoor air conditioner means installed on a vertical wall in a room;

an air intake port means provided on each lateral side of a front panel of the air conditioner means for drawing air into the air conditioner means; and air exhaust port means provided on each lateral side of the air conditioner means for discharging air from the air conditioner means, whereby air is drawn into and discharged from the air conditioner means from both lateral sides of the front panel.

4. An air conditioner as set forth in claim 3, wherein the air intake port means and the air exhaust port means provided on each lateral side of the front panel of the air conditioner means are opened facing in a forward and slanted direction.

5. An air conditioner comprising:

an indoor air conditioner means installed on a vertical wall in a room; and an air intake port means and an air exhaust port means provided on the lateral sides of the indoor air conditioner means, the air exhaust port means is provided on each side of an upper and a lower part of the indoor air conditioner means and the air intake port means is provided on each side of the indoor air conditioner means between the upper and lower air exhaust port means.

6. An air conditioner as set forth in claim 5, wherein fan means are provided in and upper and a lower part of the air conditioner means to blow air to the left and right, a heat exchanger means is provided between the upper fan means and the lower fan means, and an air passage means is provided so that the air drawn in through the air intake port means passes through the heat exchanger means and is discharged from the air conditioner means through the air exhaust port means to the left and right by the fan means.

7. An air conditioner comprising:

a vertically elongated cabinet;

reversible cross-flow fan means provided in sides of the elongated cabinet;

a heat exchanger means provided in the elongated cabinet;

a plurality of air intake port means and air exhaust port means provided on each side of the elongated cabinet through which the air is drawn in or discharged from the elongated cabinet; and an air passage means arrange so that air drawn in from at least one of the air intake port means passes through the heat exchanger means and is discharged from at least one of the air exhaust port means by action of the fan means, wherein the air intake port means and the air exhaust port means are provided on each side of an upper and lower part on the vertically elongated cabinet, the reversible cross-flow fan means are respectively provided in the elongated cabinet near the air intake port means and exhaust port means, and the heat exchanger means are provided between the upper reversible cross-flow fan means on both sides and between the lower reversible cross-flow fan means on both sides.

8. An air conditioning method, the method comprising the steps of:

providing an air conditioner means selectively operable for a heating operation and a cooling operation and including air intake port means provided at an upper and a lower part of the air conditioner means on each lateral side thereof, and air exhaust port means at the upper and lower part of the air conditioner means on each lateral side thereof;

drawing air from the air intake port means during a cooling operation, cooling the air, and discharging the cooled air from the exhaust port means; and drawing air from the air intake port means during a heating operation, heating the air and discharging the heated air from the exhaust port means.

9. An air conditioning method, the method comprising the steps of:

during a cooling operation, drawing air into an air conditioner means from a lower part on each side thereof, cooling the air, and discharging the cooled air forwardly slantwise from and upper part of the air conditioner means and on each side thereof; and during a heating operation, drawing the air into the air conditioner means from and upper part thereof and on each side thereof, heating the air, and discharging the heated air forwardly slantwise from the lower part of the air conditioner means and on each side thereof.

10. An air conditioner comprising:

an air conditioner body adapted to the embedded in a wall of a room, the air conditioner body including frame means for enabling a mounting of the air conditioner body in the wall, a design panel mounted on a front of the air conditioner, wall decorative boards mounted on each side of the air conditioner body and in front of the frame means, and air intake port means and air exhaust port means formed between the wall decorative boards and the design panel.

* * * * *